United States Patent [19]

Bubniak et al.

[11] 3,981,279

[45] Sept. 21, 1976

[54] INTERNAL COMBUSTION ENGINE SYSTEM

[75] Inventors: William C. Bubniak, Troy; Edward D. Klomp, Mount Clemens; William R. Matthes, Troy; Neil A. Schilke, Rochester, all of Mich.

[73] Assignee: General Motors Corporation, Detroit, Mich.

[22] Filed: Aug. 26, 1975

[21] Appl. No.: 608,013

[52] U.S. Cl. ..... 123/41.14; 123/41.02; 123/41.08; 123/41.09; 123/41.1; 123/41.51; 165/51

[51] Int. Cl.[2] ..... F01P 3/20

[58] Field of Search ..... 165/51; 123/41.08, 41.09, 123/41.1, 41.14, 41.51, 41.02

[56] References Cited

UNITED STATES PATENTS

| | | | |
|---|---|---|---|
| 1,591,634 | 7/1926 | Lea | 123/41.14 |
| 1,643,510 | 9/1927 | Muir | 123/41.08 |
| 2,016,179 | 10/1935 | Rosenqvist | 123/41.14 |
| 2,067,924 | 1/1937 | Illsley | 123/41.1 |
| 2,084,940 | 6/1937 | Caldwell | 123/41.14 |
| 3,080,857 | 3/1963 | Middendorf | 123/41.1 |
| 3,190,272 | 6/1965 | Falk | 123/41.09 |
| 3,242,914 | 3/1966 | Benger | 123/41.1 |
| 3,621,907 | 11/1971 | Ephraim | 123/41.14 |
| 3,757,984 | 9/1973 | Barton | 123/41.14 |
| 3,853,270 | 12/1974 | Prebil | 123/41.14 |

*Primary Examiner*—Charles J. Myhre
*Assistant Examiner*—Daniel J. O'Connor
*Attorney, Agent, or Firm*—Ronald L. Phillips

[57] ABSTRACT

An internal combustion engine system having a pressurized liquid coolant system whose coolant level automatically adjusts to effect rapid combustion chamber surface temperature rise on cold start. The coolant system includes a valve which automatically opens to drain coolant from the coolant system to a reservoir in response to coolant system pressure falling below a predetermined value because of temperature decrease on engine shut-off to establish a below-normal coolant level relative to the combustion chamber surface when the engine is cold and permits the drained coolant to be pumped back to the coolant system on cold start and then closes in response to coolant system pressure rise above the predetermined value because of coolant temperature increase on engine start-up to establish and maintain the normal coolant level for engine cooling. The coolant system further includes an orifice in the thermostat control valve which is sized to control the rate of air pressure change in the coolant system to prolong establishment of the normal coolant level for a substantial time period on cold start.

2 Claims, 9 Drawing Figures

INTERNAL COMBUSTION ENGINE SYSTEM

This invention relates to an internal combustion engine system and more particularly to a coolant system therefor which operates to provide rapid combustion chamber surface temperature increase on cold start.

It has been found that in an internal combustion engine system the combustion chamber surface temperature has an important influence on hydrocarbon emissions irrespective of charge preparation. One known way of accomplishing rapid combustion chamber surface temperature rise is to remove coolant from around the combustion chamber during cold start. However, difficulty arises in providing a simple and practical modification to current production systems which will automatically control the coolant level within the engine so that it is substantially below the normal level on cold start and later somehow assumes the normal level for normal engine cooling.

The present invention meets these requirements in a conventional engine system with simply an enlarged coolant reservoir, an additional hose connection from the reservoir to the water pump inlet, a pressure responsive coolant level control valve between the reservoir and water pump and a prescribed size of vent hole in bypass relationship with the thermostat control valve. When the engine is cold resulting in pressure decrease in the coolant system the pressure responsive coolant level control valve automatically opens to drain coolant from the engine to the reservoir to establish a below-normal coolant level relative to the combustion chambers. Then when the engine is started cold, the pump begins to circulate coolant within the engine and also draws coolant from the reservoir through the pressure responsive coolant level control valve. The rate at which coolant is drawn from the reservoir is controlled by the vent hole in the then closed thermostat control valve and as the engine begins to warm up the coolant level in the reservoir drops and the level in the radiator and engine begins to rise until the normal coolant level is reached. When the engine cooling load increases and the cooling system begins to pressurize the pressure responsive coolant level control valve closes and prevents flow back into the coolant reservoir whereby the coolant is then contained at its normal level and operates in the normal pressurized condition necessary for maximum cooling efficiency. Then when the engine is turned off and the coolant temperature begins to drop off the pressure responsive coolant level and control valve again opens and allows the coolant to drain into the reservoir. The vent hole in the thermostat control valve thus provides a controlled fill rate of the engine and this is determined to be slow enough to obtain the benefits of a non-liquid cooled combustion chamber on cold start but fast enough to prevent local engine overheating and/or pre-ignition.

An object of the present invention is to provide a new and improved internal combustion engine system.

Another object is to provide in an internal combustion enginge system an improved coolant system providing rapid combustion chamber surface temperature rise on cold start.

Another object is to provide in a coolant system for an internal combustion engine a pressure responsive coolant level control valve that automatically operates in response to coolant system pressure change to control communication between the engine's normal coolant circulation system and a reservoir to provide a low coolant level on cold start to then effect a rapid combustion chamber surface temperature increase and to establish the normal coolant level after engine warm-up under the control of a prescribed size vent hole in bypass relationship with the thermostat control valve.

Another object is to provide in an internal combustion engine system a coolant system employing a pressure responsive coolant level control valve between the engine's normal coolant circulation system and a reservoir and a prescribed size of vent hole between the coolant passages in the engine and the radiator in bypass relationship with the thermostat control valve which cooperatively operate to automatically effect a below-normal coolant level relative to the combustion chamber when the engine is cold to effect rapid combustion chamber surface temperature rise and after a prescribed time establish and maintain the normal coolant level.

These and other objects and advantages of the present invention will be more apparent from the following description and drawing in which.

Figure 1:
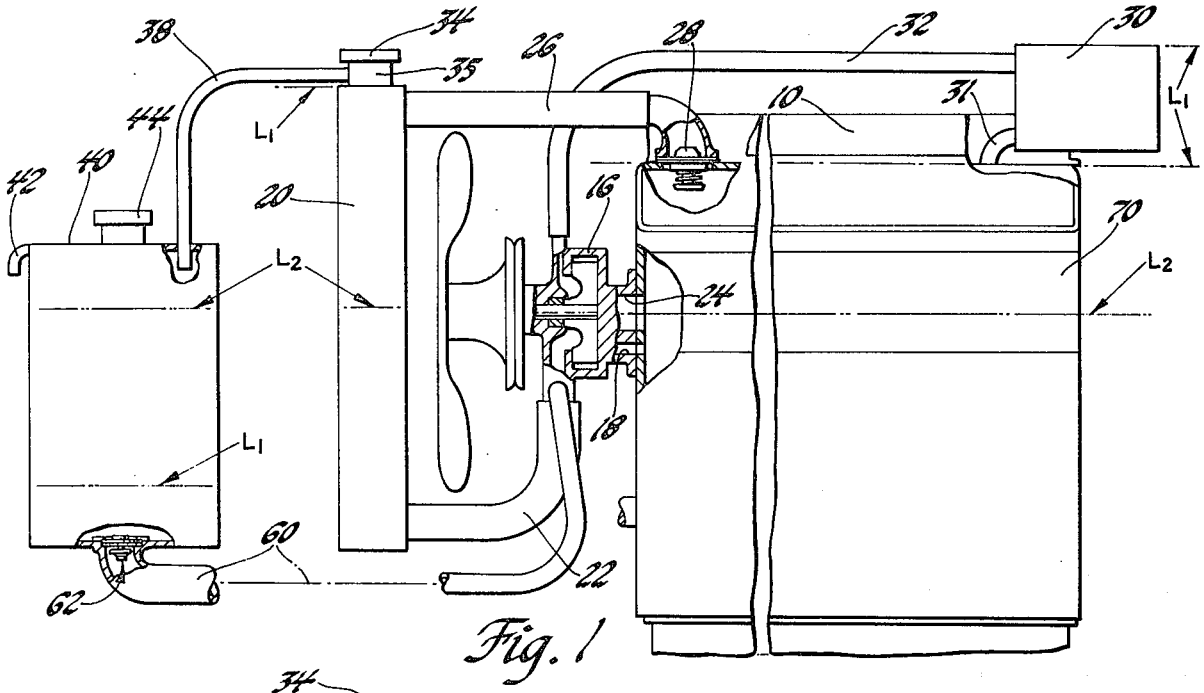
FIG. 1 is a diagrammatic view in side elevation of an internal combustion engine system according to the present invention.
Figure 5:
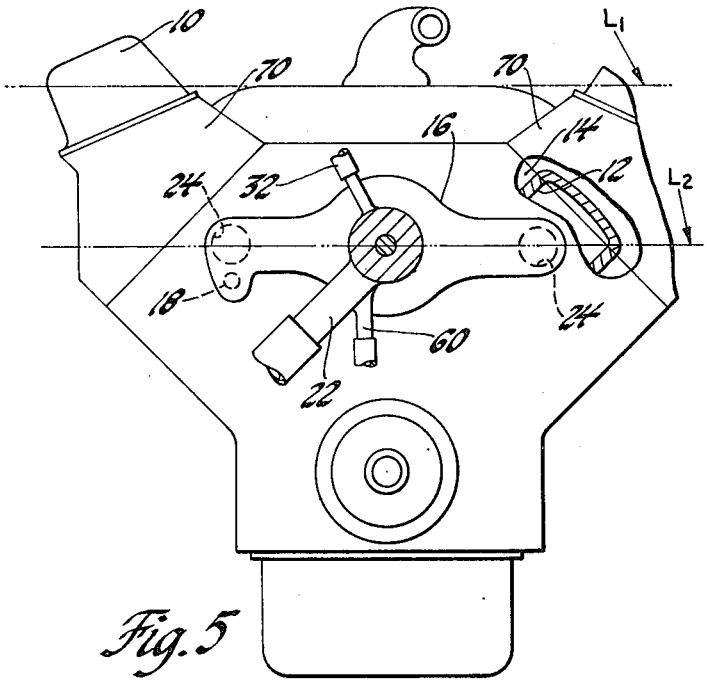
FIG. 5 is a front elevation of the engine.

There is shown in FIGS. 1 and 5 a typical current production internal combustion engine 10 of the V-8 overhead valve type having combustion chambers 12 with liquid coolant passages 14 thereabout for cooling same during normal engine operation with pressurized liquid coolant. A pump 16 driven from the engine crankshaft receives coolant on its inlet side from the engine's coolant passages 14 through a bypass 18 and from a radiator 20 through a hose 22 and delivers the coolant to the coolant passages 14 through a pump outlet 24. Coolant heated by the engine is delivered to the top of the radiator 20 by a hose 26 with a thermostat control valve 28 responsive to engine coolant temperature operating to block the radiator flow below a certain engine temperature, i.e. when the engine is cold and gradually opening with increasing coolant temperature and attaining an equilibrium condition with constant load to establish the desired engine operating temperature. A passenger space heater 30 receives heated coolant from the engine through a hose 31 and the coolant exiting the heater is delivered by a hose 32 to the pump inlet.

Figure 2:
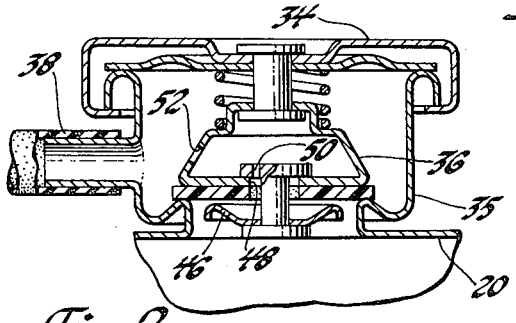
FIG. 2 is a cross-sectional view of the radiator pressure cap in the system.
Figure 4:
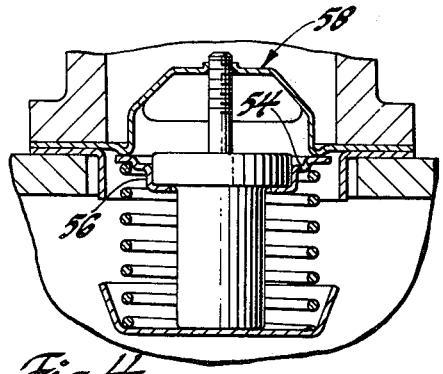
FIG. 4 is a cross-sectional view of the thermostat control valve with the prescribed vent hole.

As shown in FIGS. 1 and 2 the coolant system further includes a radiator-cap pressure-valve assembly 34 which closes the radiator fill neck 35 and has a spring biased relief valve 36 that is calibrated to open at a certain setting to relieve the pressure in the coolant system with any coolant overflow being directed by a hose 38 to a reservoir 40. The overflow hose 38 extends through the top of the reservoir and terminates above the highest expected liquid level therein, the reservoir above the liquid level always being open to atmosphere through an atmospheric vent 42 and further having a capped fill opening 44 which is for adding coolant to the system rather than directly into the radiator by removal of the radiator-cap pressure-valve assembly 34. The radiator-cap pressure-valve assembly 34 further has a vacuum valve 46 which assumes the open position shown in FIG. 2 when the pressure in the closed coolant system falls below atmospheric pressure to then open the engine's coolant system through passages 48, 50 and 52 in the valve assembly to the overflow tube 38 and thus to atmosphere through the reservoir vent 42. In addition to the vent in the radiator-cap pressure-valve assembly 34 there may also be provided a vent hole 54 in the valve member 56 of the thermostat control valve 58 so that when the thermostat control valve is closed as shown in FIG. 4 the coolant system upstream of this valve is also ventable by the vent valve 46 in the radiator-cap pressure-valve assembly.

The system thus far described operates to effect limited pressurization of the coolant system, to block coolant flow to the radiator during cold engine running and to permit flow thereafter. Any overflow resulting from the pressure relief of the system is directed to the reservoir and is pumped back into the engine in accordance with the present invention whenever the pressure in the coolant system drops below atmospheric pressure because of decrease in engine temperature as will now be described in detail.

Figure 3:
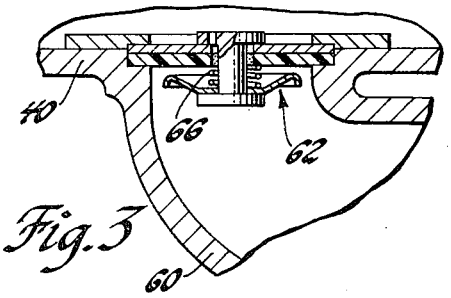
FIG. 3 is a cross-sectional view of one embodiment of the pressure responsive coolant level control valve.
Figure 6:
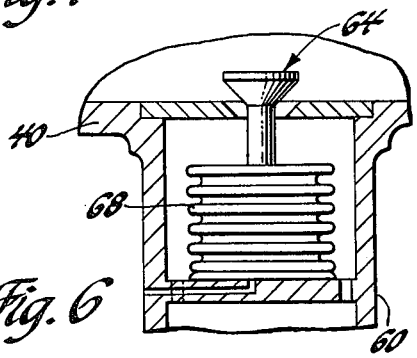
FIG. 6 is a cross-sectional view of another embodiment of the pressure responsive coolant control valve.

Describing now the details of the simple and practical modifications that can be made to the above described system to provide rapid combustion chamber wall temperature increase on cold start to significantly improve engine combustion characteristics and thereby substantially reduce hydrocarbon emissions in particular, the reservoir 40 (assuming it is not already of sufficiently overlarge capacity) is enlarged and an additional hose 60 is added to connect the bottom thereof to the suction or inlet side of the pump. In addition, a pressure responsive flow control valve in the form of a spring biased poppet valve 62 as shown in FIGS. 1 and 3 or in the form of a bellows biased valve 64 as shown in FIG. 6 is located in the connection-between the reservoir and pump inlet. The pressure responsive flow control valve is calibrated to open to permit flow whenever the engine coolant system pressure falls below atmospheric pressure and closes to block coolant flow whenever the coolant system pressure rises above atmospheric pressure. Lastly, the existing vent hole 54 in the thermostat control valve 58 is provided with a prescribed size or if there is no vent hole one of proper size is newly provided, the determination of the vent hole size being described in detail later.

With these modifications and when the engine 10 is fully warmed-up, the operation is the same as in the conventional case. Depending upon ambient conditions, the thermostat control valve 58 will have attained an equilibrium position with constant load. Whatever the thermostat control valve position, the inlet at the top of the radiator 20 cannot be at a pressure less than ambient pressure because of the vacuum valve 46 in the radiator-cap pressure-valve assembly 34. If the pressure on the trapped gas at the inlet of the radiator is ambient, the static pressure at the inlet of the pump 16 is normally higher than ambient because of the static head produced by the coolant in the radiator. However, if the static pressure at the pump inlet should be lower than ambient, there would be a tendency to pump liquid coolant from the reservoir into the engine coolant system and thereby raise the pressure of the trapped gas at the top of the radiator above ambient. This flow direction is permitted by the pressure responsive flow control valve either 62 or 64 which operates to remain open so long as the system pressure is lower than atmospheric pressure. In the case of the spring bias type valve 62, a valve spring 66 opposes system pressure to open the valve when system pressure falls to a value slightly above the coolant pressure in the reservoir which is at atmospheric pressure and in the case of the bellows type valve 64 a metal bellows 68 which has a predetermined spring rate and is open to atmosphere expands against system pressure to open the valve when system pressure falls below atmospheric pressure. when the engine is fully warmed-up, system pressure will normally everywhere be substantially above ambient and the pressure responsive flow control valve, either 62 or 64, will be closed by this increased pressure thus removing or disconnecting the reservoir 40 from the flow circuit. If the system pressure starts to exceed the level for which the system is designed, the relief valve 36 in the radiator-cap pressure-valve assembly 34 will open to relieve the excess pressure in the conventional manner with the overflow directed to the reservoir.

When the engine is shut down, the pressure responsive flow control valve, either 62 or 64, will remain closed until the system pressure drops to ambient. When the system pressure reaches ambient the pressure responsive flow control valve will open gradually and permit draining of the heater 30, the engine 10 and the radiator 20 to the reservoir 40 with the liquid level eventually falling from its engine warm level designated as $L_1$ to a below-normal level designated as $L_2$. As shown in FIG. 5 this reduced level is determined to be at least low enough to remove coolant from the cylinder heads 70 and thus from around the top of the combustion chambers 12 which are believed to be the main source of quench layer hydrocarbon emissions.

Thus for a cold start the coolant level is at $L_2$ in the engine, radiator and reservoir. When the engine starts, the thermostat control valve 58 is fully closed and the pressure responsive flow control valve, either 62 or 64, is wide open. The coolant pump 16 then pumps coolant from both the reservoir 40 and the radiator 20 into the engine 10 but this is inhibited by the thermostat control valve 58 since the air in the coolatn system ahead of the coolant being pumped can then only exhaust through the vent 54. The size of this vent 54 is determined so that it inhibits or limits the coolant being pumped to a predetermined fill rate of the engine which is made slow enough to obtain the benefits of a dry cylinder head region but fast enough to prevent local overheating and/or pre-ignition. This time is experimentally determined based on maximum allowable combustion chamber surface temperature. While this is occurring the vacuum valve 46 is open venting the top of the radiator to atmospheric pressure through the reservoir 40 and will not close until the coolant rises in the top of the radiator to the normal operating level $L_1$. At this point the coolant in the engine is at its normal level and the coolant system then functions in the normal manner. when the engine cooling load increases and the coolant system begins to pressurize, the pressure responsive flow control valve, either 62 or 64, responds to this rising pressure and closes to prevent flow from the engine into the coolant reservoir 40. The coolant system is then conditional to operate in the normal pressurized manner for maximum cooling efficiency.

Then when the engine is turned off and the coolant temperatures drop, the pressure responsive flow control valve opens and allows the coolant to drain from the cylinder heads with this rate again controlled by the vent hole 54 in the thermostat control valve. When the engine is again cold the low level $L_2$ is re-established for a subsequent cold start.

Figure 7:
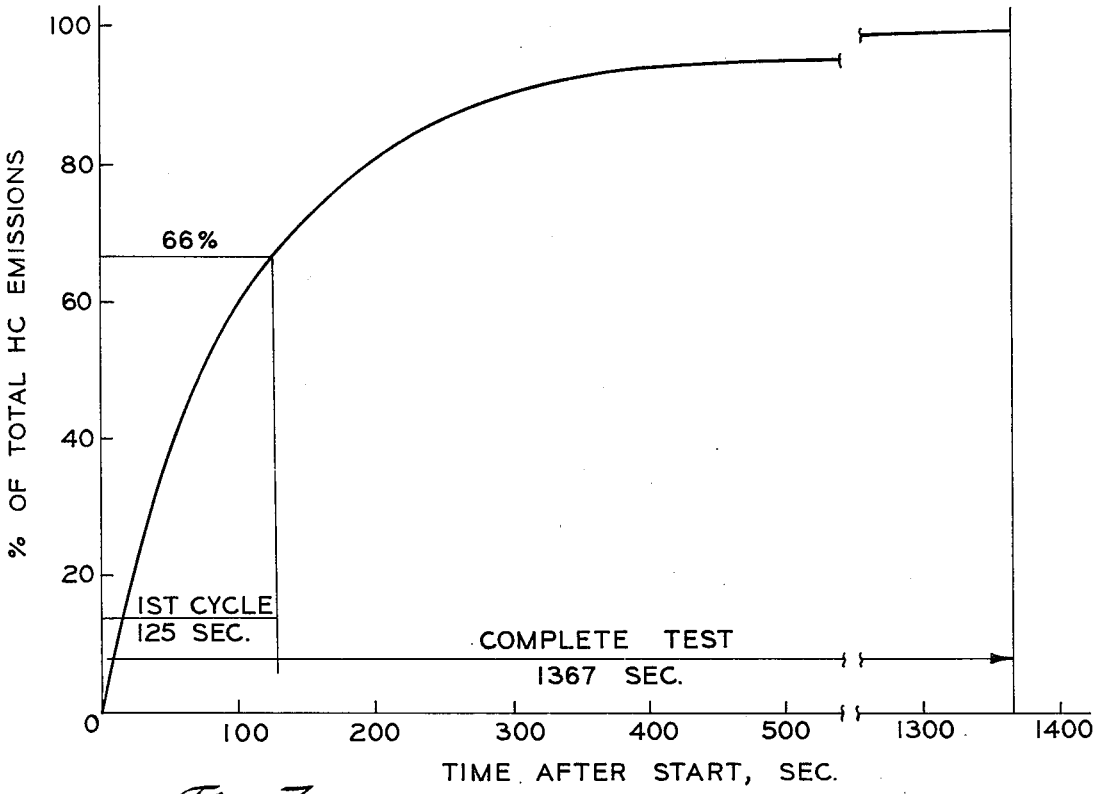
FIG. 7 is a plot of total HC mass emissions versus time after engine start-up on a current production internal combustion engine when driven on the 1975 FTP emission test.

The significance of warm-up hydrocarbon (HC) emissions from a production engine is shown in FIG. 7 wherein a 1975 Chevrolet Bel Air was run on the first 18 driving cycles (cold plus stabilized bags) of the Federal Test Procedure (FTP) test. This test showed that about 66% of the total HC emissions occur within about the first two minutes of this engine's operation or less than 10% of the total time of the test. Thus, for this vehicle the size of the orifice or vent hole 54 in the thermostat control valve 58 would be experimentally established so that the change from coolant level $L_2$ to the normal coolant level $L_1$ takes at least about two or three minutes after cold start and it was found that this time could even be extended to about five minutes without deleterious engine effects in this series of tests.

Figure 8:
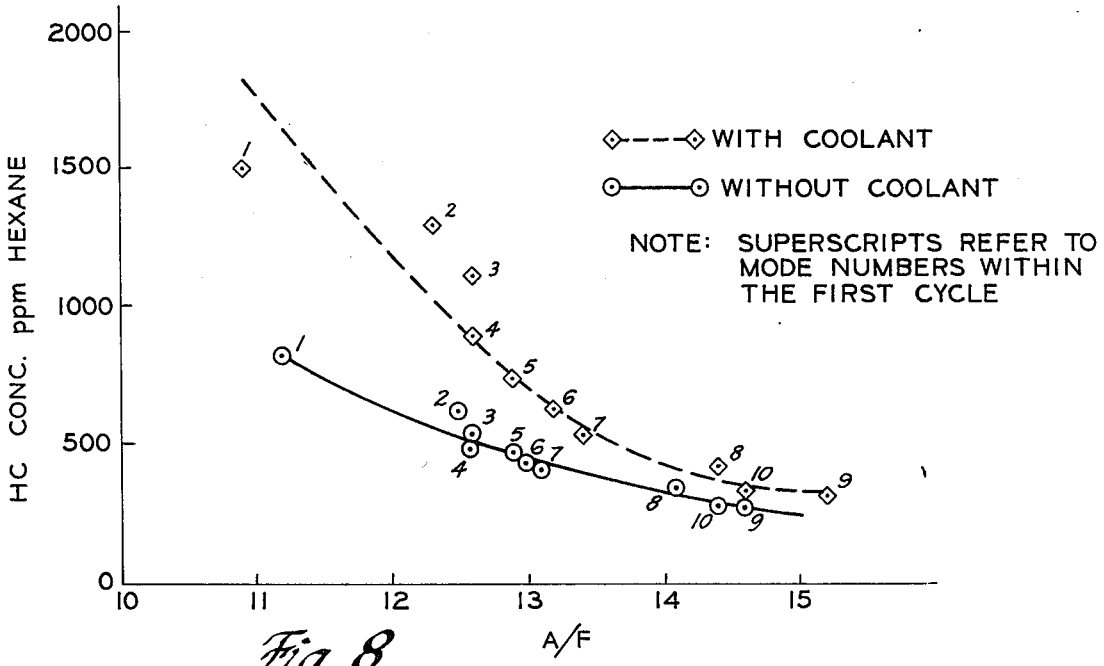
FIG. 8 is a plot of HC concentration versus air-fuel ratio on the engine producing the FIG. 7 results wherein the system was run with and without coolant.
Figure 9:
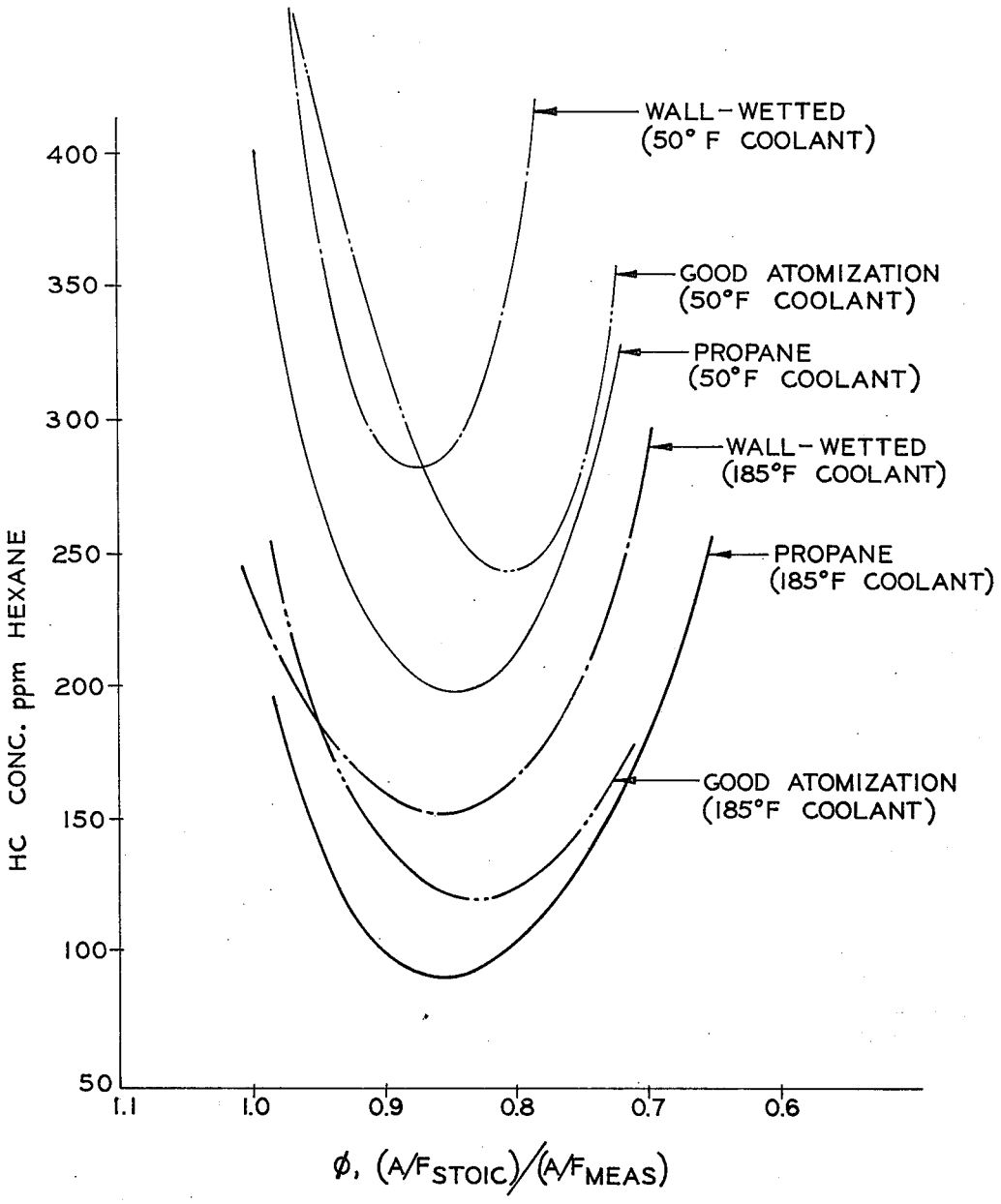
FIG. 9 is a plot of HC concentration versus equivalence ratio on a single cylinder engine run with good and wall-wetted gasoline atomization and also with propane at different coolant temperatures.

The significance of combustion chamber surface temperature on HC emissions is shown in FIGS. 8 and 9. Referring first to FIG. 8, there is shown the results of first cycle tests of the FTP test on the same 1975 Bel Air with and without coolant. These tests show that cold starts without engine coolant in the first cycle produced a reduction in first cycle HC emissions averaging about 26%. Furthermore, these tests agains showed that the largest gains are made within the first few minutes of operation, i.e. modes 1–6 of the first cycle, which is probably because this is where the difference in wall temperature is the greatest with and without engine coolant with the differences in HC concentrations becoming smaller in the last half of the first cycle, namely modes 6–10. A leaner first cycle schedule was also tested since it was thought that for very rich mixtures the HC emissions associated with the bulk gas could be a significant portion of the total HC emission and that the quench layer effect would not be as dominant. With the leaner first cycle schedule the unburned HC from the bulk gas should not be as large when compared to the quench layer effect and therefore increased combustion chamber surface temperature should result in a greater percentage of HC reduction. For the lean first cycle air-fuel ratio schedule the average reduction in mass emissions was about 19% as compared to the average reduction of about 26% for the rich first cycle air-fuel ratio schedule. Comparing the first cycle HC emisions for both lean and rich air-fuel ratio scheduling shows that the percentage reduction is not very sensitive to air-fuel ratio in this range which implies that a majority of HC emissions appear to come from the quench layer and that the amount from the bulk gas is realtively small. Thus, cold engine starts without coolant about the combustion chamber is believed to be a substantial contributor or HC emission reduction as well as the adjustment of the air-fuel ratio.

As a further indication of the advantages to be gained from the present invention there is shown in FIG. 9 the results of single-cylinder engine dynamometer studies which indicate that cold combustion chamber surfaces can significantly increase HC emissions. In these tests liquid fuel was injected directly on the intake port adjacent the intake valve (wall-wetted), propane was used as a fuel and also liquid fuel with good atomization was used. The single-cylinder engine was run at two engine coolantt temperatures, 185°F and 50°F, which correspond to cylinder wall temperatures of about 265°F and 140°F, respectively. These tests clearly indicate that cold combustion chamber surfaces significantly increase HC emissions. These tests also showed that improved atomization had little effect on HC emission levels for cold wall temperatures and near-stoichiometric air-fuel ratio mixtures as might be encountered during engine warm-up. The studies with propane at the same hot and cold coolant temperatures indicate that the high HC emissions probably result from a thicker gaseous quench layer rather than from fuel condensation on the combustion chamber walls. Furthermore, it will be noted that the wall temperature influence on hydrocarbon emissions irrespective of charge preparation is greater in the equivalence ratio range from 0.75 – 0.95, the equivalence ratio being the ratio of the stoichiometric air-fuel ratio to the measured air-fuel ratio. These tests also indicated that while it is generally advantageous to have good atomization and even more advantageous to employ propane, the effect of wall temperature in even more pronounced than that of mixture preparation wherein as shown by raising the wall temperature from 140°F to 265°F the HC emission are about halved.

In the present invention which is shown can be practiced with simple modification of a conventional pressurized coolant system the coolant level is lowered below normal for cold start and then does not reach the normal level to circulate fully about the combustion chambers until after a prescribed period that is determined to occur after the engine has substantially warmed up. As a result, the combustion chamber wall temperature rapidly increases on cold start to substantially reduce HC emissions and then when the engine has warmed up, the coolant system is then conditioned to operate in the normal pressurized condition for maximum cooling efficiency.

The above described embodiments are illustrative of the invention which may be modified within the scope of the appended claims.

We claim:

1. An internal combustion engine system characterized by rapid combustion chamber surface temperature increase on cold start comprising in combination:

an internal combustion engine having at least one combustion chamber and liquid coolant passages about said chamber to cool same during normal engine operation;

a heat exchanger connected to receive liquid coolant from and after cooling return the liquid coolant to said liquid coolant passages;

a pump means driven by said engine for circulating liquid coolant through said liquid coolant passages and heat exchanger;

a thermostat control valve means for controlling liquid coolant flow from said liquid coolant passages to said heat exchanger wherein flow is blocked when the engine is cold and flow is permitted at an increasing rate with increasing liquid coolant temperature as engine temperature increases;

a reservoir means having an atmospheric vent;

a pressure regulator means for regulating the pressure of the circulating liquid coolant and delivering the overflow to said reservoir;

a vent valve means for venting said heat exchanger and liquid coolant passages to said reservoir;

said reservoir means also connected to said pump and of size and elevation relative to said heat exchanger and said liquid coolant passages so that liquid coolant can drain thereto to substantially lower the liquid coolant level about said combustion chamber below a normal level;

pressure responsive flow control valve means in the connection between said reservoir and the inlet of said pump operable to open in response to the liquid coolant pressure in said heat exchanger and coolant passages falling below a predetermined value as the result of liquid coolant temperature decrease on engine shut-off and operable to close in response to the liquid coolant pressure rising above said predetermined value because of temperature increase after cold engine start providing means whereby liquid coolant drains to said reservoir to establish a below-normal liquid coolant level about said combustion chamber when the engine is cold and is pumped back into said heat exchanger and liquid coolant passages on cold start to establish the normal liquid coolant level which is thereafter maintained for normal engine cooling;

and orifice means of predetermined size in bypass relationship wth said thermostat control valve for operating when the thermostat control valve is closed on cold engine start to vent said liquid coolant passages at a limited rate to prolong the change from the below-normal to normal liquid coolant level for a predetermined substantial time period during cold start operation providing means whereby normally liquid cooled portions of said combustion chamber are not cooled until a substantial time period after cold start.

2. An internal combustion engine system characterized by rapid combustion chamber surface temperature increase on cold start comprising in combination:

an internal combustion engine having at least one combustion chamber below a cylinder head and liquid coolant passages in said cylinder head about said chamber to cool same during normal engine operation;

a heat exchanger connected to receive liquid coolant from and after cooling return the liquid coolant to said liquid coolant passages;

a pump means driven by said engine for circulating liquid coolant through said liquid coolant passages and heat exchanger;

a thermostat control valve means including a movable valve element for controlling liquid coolant flow from said liquid coolant passages to said heat exchanger wherein flow is blocked when the engine is cold and flow is permitted at an increasing rate with increasing liquid coolant temperature as engine temperature increases;

a reservoir means having an atmospheric vent;

a pressure regulator means for regulating the pressure of the circulating liquid coolant and delivering the overflow to said reservoir;

a vent valve means for venting said heat exchanger and liquid coolant passages to said reservoir;

said reservoir means also connected to said pump and of size and elevation relative to said heat exchanger and said liquid coolant passages so that liquid coolant can drain thereto to substantially lower the liquid coolant level in said cylinder head below a normal level;

pressure responsive flow control valve means in the connection between said reservoir and the inlet of said pump operable to open in response to the liquid coolant pressure in said heat exchanger and coolant passages falling below a predetermined value as the result of liquid coolant temperature decrease on engine shut-off and operable to close in response to the liquid coolant pressure rising above said predetermined value because of temperature increase after cold engine start providing means whereby liquid coolant drains to said reservoir to establish a below-normal liquid coolant level in said cylinder head when the engine is cold and is pumped back into said heat exchanger and liquid coolant passages on cold start to establish the normal liquid coolant level which is thereafter maintained for normal engine cooling;

and orifice means of predetermined size in the movable valve element of said thermostat control valve for operating when the thermostat control valve is closed on cold engine start to vent said liquid coolant passages immediately downstream of said thermostat control valve at a limited rate to prolong the change from the below-normal to normal liquid coolant level for a predetermined substantial time period during cold start operation providing means whereby normally liquid cooled portions of said combustion chamber are not cooled until a substantial time period after cold start.

* * * * *